United States Patent [19]

Stephenson

[11] 4,255,934

[45] Mar. 17, 1981

[54] CLOSED LOOP POWER SYSTEM

[75] Inventor: Roger B. Stephenson, Pompano Beach, Fla.

[73] Assignee: John T. Bender, Jr., Delray Beach, Fla. ; a part interest

[21] Appl. No.: 121,103

[22] Filed: Feb. 13, 1980

[51] Int. Cl.[3] ..... F01K 23/04

[52] U.S. Cl. ..... 60/655; 60/682

[58] Field of Search ..... 60/516, 530, 650, 651, 60/671, 682, 655

[56] References Cited

U.S. PATENT DOCUMENTS

| | | | |
|---|---|---|---|
| 740,859 | 10/1903 | Houkowsky | 60/651 |
| 3,055,170 | 9/1962 | Westcott, Jr. | 60/682 X |
| 4,107,928 | 8/1978 | Kelly et al. | 60/530 X |
| 4,134,265 | 1/1979 | Schlueter | 60/516 |

*Primary Examiner*—Allen M. Ostrager

*Assistant Examiner*—Stephen F. Husar

*Attorney, Agent, or Firm*—Oltman and Flynn

[57] ABSTRACT

In the present system, Freon is recirculated in a closed loop which includes a first heat exchanger having a tank for holding Freon in a liquid state at elevated temperature and pressure, and second, third, and fourth heat exchangers which receive Freon at different times from the first heat exchanger by gravity flow and successively cool, heat and discharge the heated Freon in a liquid state through a fluid motor whose discharge is connected back to the tank in the first heat exchanger. Water from the cooling tower of a steam power plant is used to cool the Freon in the first heat exchanger and at different times in the other heat exchangers. Hot water from the waste steam outlet of steam turbines in the steam power plant is used to heat the Freon at other times in the second, third and fourth heat exchangers.

6 Claims, 1 Drawing Figure

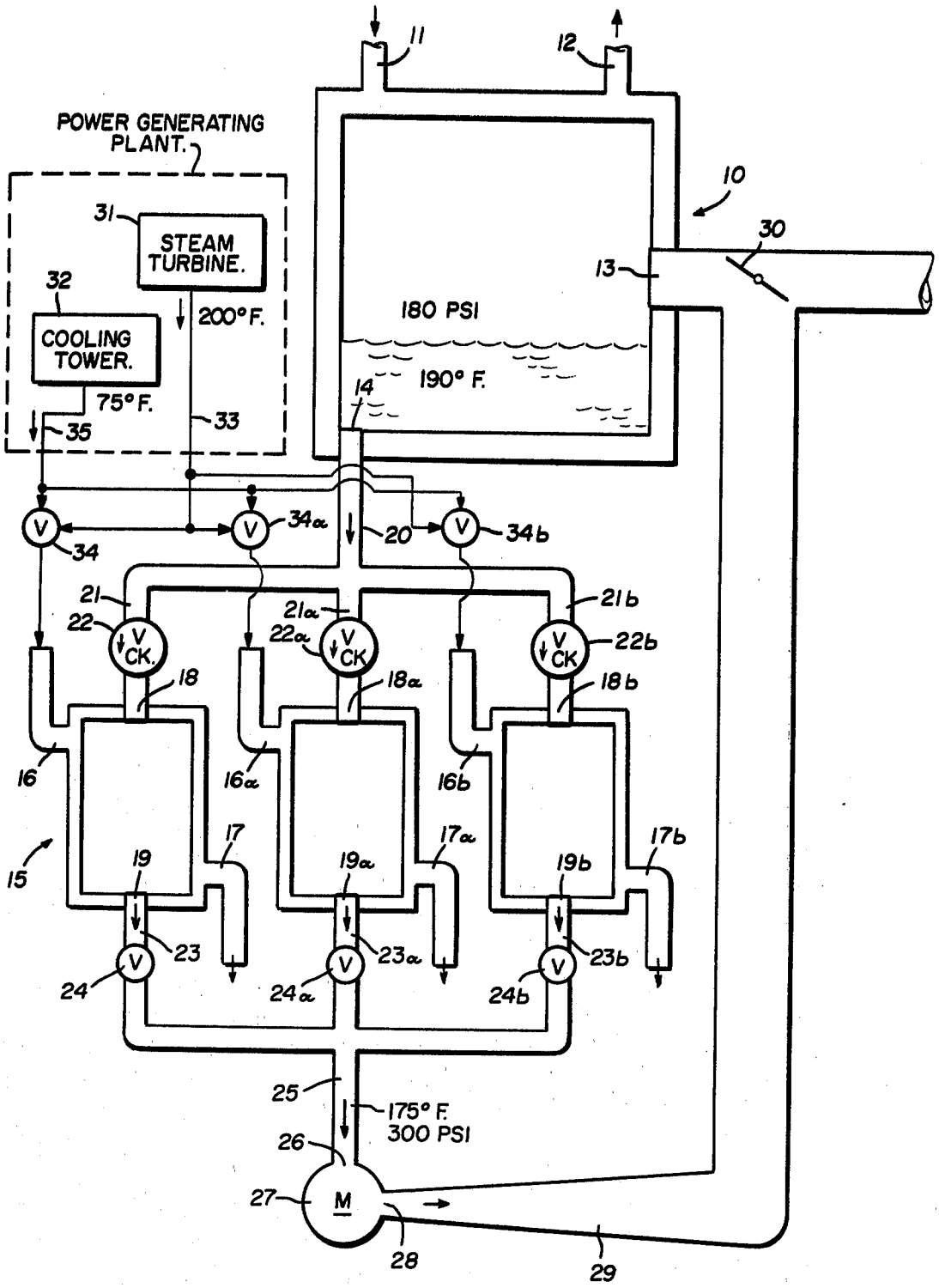
POWER GENERATING PLANT.
STEAM TURBINE.
COOLING TOWER.
200° F.
75° F.
180 PSI
190° F.
175° F.
300 PSI
M
V
V CK.
V CK
10
11
12
13
14
15
16
16a
16b
17
17a
17b
18
18a
18b
19
19a
19b
20
21
21a
21b
22
22a
22b
23
23a
23b
24
24a
24b
25
26
27
28
29
30
31
32
33
34
34a
34b
35

CLOSED LOOP POWER SYSTEM

SUMMARY OF THE INVENTION

This invention relates to a power system using a refrigerant fluid, such as Freon, or another suitable working fluid, operating in a closed loop which includes heat exchangers and a fluid motor.

Preferably, the present system is used in conjunction with a conventional steam power plant in which waste hot water is produced by one or more steam turbines and cooling water is provided by a cooling tower. Heat exchangers in the present closed loop power system are operated by these sources of hot water and cooling water in the steam power plant.

The present system has an upper heat exchanger for receiving the working fluid from the outlet of the fluid motor and for cooling the working fluid down to the temperature which is still well above the ambient temperature and at a pressure well above atmospheric pressure. One or more lower heat exchangers are connected to receive the pressurized working fluid in a liquid state from the upper heat exchanger through respective check valves. Each lower heat exchanger, after receiving the working fluid, first is cooled by the cooling water and then is heated by the hot water to establish a pressure in the respective lower heat exchanger substantially above the pressure in the upper heat exchanger. The heated, pressurized working fluid is discharged from the lower heat exchangers, one at a time, into the fluid motor, and the working fluid is recovered from the motor outlet and is passed back into the upper heat exchanger, completing the system loop. Preferably, the cooling, heating and discharge phases of operation of the lower heat exchangers are staggered as to provide a continuous pressurized liquid input to the fluid motor. For example, while one lower heat exchanger is being cooled, a second lower heat exchanger may be heated, and a third lower heat exchanger may be discharging the heated, pressurized working fluid into the fluid motor.

A principal object of this invention is to provide a novel and improved closed loop power system.

Another object of this invention is to provide such a power system which may be advantageously associated with a conventional steam power plant to make use of hot water and cooling water which would otherwise be wasted there.

Another object of this invention is to provide a novel closed loop power system containing one or more heat exchangers in which pressurized working fluid is first cooled and then heated to a substantially higher pressure while remaining in a liquid state, and then is discharged in a liquid state into a fluid motor.

Further objects and advantages of this invention will be apparent from the following detailed description of a presently-preferred embodiment which is shown schematically in the single Figure of the accompanying drawing.

DESCRIPTION OF THE DRAWING

The single FIGURE of the drawing shows schematically the present closed loop power system connected to the cooling tower and a steam turbine in a conventional steam power plant.

Before explaining the disclosed embodiment of the present invention in detail, it is to be understood that the invention is not limited in its application to the details of the particular arrangement shown since the invention is capable of other embodiments. Also, the terminology used herein is for the purpose of description and not of limitation.

DETAILED DESCRIPTION

Referring to the drawing, the present system comprises first heat exchanger with a water-cooled upper tank 10 for holding Freon or other suitable refrigerant fluid in a liquid state at a temperature and pressure substantially above the ambient temperature and pressure at the site. The upper tank has a hollow outer jacket with a cold water inlet 11 and a water outlet 12. Inside this water jacket the tank defines a refrigerant container with an inlet 13 for the refrigerant fluid and a bottom outlet 14 for the refrigerant fluid.

Three tanks 15, 15*a* and 15*b* are positioned below the upper tank 10 so that they can receive the refrigerant fluid by gravity flow from the outlet 14 in the bottom of the upper tank. Each of the lower tanks 15, 15*a* and 15*b* has a hollow water jacket surrounding an inner container. The inner container holds the refrigerant fluid, and cooling water and hot water are circulated through the outer jacket at different times during the operating cycle of the system, as explained hereinafter.

The upper tank 10 acts as a heat exchanger for cooling the refrigerant fluid with water, and each of the lower tanks 15, 15*a* and 15*b* acts as a heat exchanger for cooling and heating the refrigerant fluid with water at different times during the operating cycle.

Referring to the lower tank 15, its outer jacket has a water inlet 16 near the top and a water outlet 17 near the bottom, and its inner container has a refrigerant inlet 18 in the top and a refrigerant outlet 19 in the bottom.

Each of the other lower tanks 15*a* and 15*b* has similar water and refrigerant inlets and outlets, which are identified by the same reference numerals as those for the tank 15 but with a respective "a" or "b" suffix added to distinguish them.

An outlet pipe 20 extends down from the refrigerant outlet 14 in the upper tank 10 to three branch pipes 21, 21*a* and 21*b*, which lead down to the refrigerant inlets 18, 18*a* and 18*b* of the lower tanks 15, 15*a* and 15*b*, respectively. A one-way check valve 22 in branch pipe 21 permits the refrigerant liquid to flow by gravity down into the lower tank 15 but prevents reverse flow from the lower tank 15 back up into the upper tank 10. Similar check valves 22*a* and 22*b* are located in the respective branch pipes 21*a* and 21*b* leading to the lower tanks 15*a* and 15*b*, respectively.

The refrigerant outlet 19 at the bottom of tank 15 is connected to an outlet pipe 23 in which a shutoff valve 24 is located. Similarly, the refrigerant outlet 19*a* at the bottom of tank 15*a* is connected to an outlet pipe 23*a* in which a shutoff valve 24*a* is located, and the refrigerant outlet 19*b* in the bottom of tank 15*b* is connected to an outlet pipe 23*b* in which a shutoff valve 24*b* is located. At the outlet side of these valves the respective pipes 23, 23*a* and 23*b* are all connected to a pipe 25 which leads to the inlet 26 of a vane motor 27. The outlet 28 of the vane motor is connected to a return pipe 29 which extends up past a gate valve 30 to the refrigerant inlet 13 of the upper tank 10.

This system is adapted for use with a conventional power generating plant having one or more steam turbines 31 and a cooling tower 32, both of known design and both shown schematically as blocks in the drawing.

Waste steam from the turbine 31 is a source of hot water which may be used to heat the refrigerant liquid in each of the lower tanks 15, 15*a* and 15*b* at various times during the cycle of operation of the present system, as described hereinafter. The cooling tower 32 is a source of cool water which may be used to cool the refrigerant liquid in each of the lower tanks 15, 15*a* and 15*b* at other times during the operating cycle of this system.

Alternatively, the cooling water may be provided by a well or other source.

The waste steam outlet of the steam turbine 31 is connected to a pipe 33, which has separate connections through valves 34, 34*a* and 34*b*, respectively, to the respective inlets 16, 16*a* and 16*b* of the water jackets of the lower tanks 15, 15*a* and 15*b*. Each of these valves has two separate inlets and a single outlet. The first inlet of each valve 34, 34*a* and 34*b* is connected to the waste steam outlet of the steam turbine 31. The outlet of each valve is connected to the water inlet 16, 16*a* and 16*b* of the respective tank 15, 15*a* or 15*b*. The cooling tower 32 has a cool water outlet which is connected to a pipe 35 leading to the second inlet of each valve 34, 34*a* and 34*b*. In one practical embodiment, the water coming from the cooling tower 32 has a temperature of about 75° F. and the hot water coming from the waste steam outlet of the turbine 31 is at a temperature of about 200° F.

The water supplied to the water jacket of the upper tank 10 at the inlet 11 is from any convenient source of cold water.

The system is filled with enough working fluid, such as Freon or other suitable refrigerant fluid to keep a suitable liquid level of the working fluid in the upper tank 10 while two of the three lower tanks 15, 15*a* and 15*b* are filled and the other lower tank is discharging the working fluid through the vane motor 27.

In the operation of this system, for purposes of discussion it will be assumed that the lower tanks 15, 15*a* and 15*b* are operated in that sequence.

First, the liquid refrigerant working fluid at a temperature of about 190° F. and a pressure of about 180 psi in the upper tank 10 is supplied by gravity flow down into tank 15. After tank 15 is filled, water at about 75° F. is supplied from the cooling tower 32 through valve 34 to the water jacket of tank 15 to cool the liquid refrigerant inside this tank to about 80° F.

Following this cooling step, valve 34 is actuated to disconnect the cooling tower 32 from the water inlet 16 of tank 15 and to connect the waste steam outlet of the steam turbine 31 to water inlet 16. Consequently, hot water at about 200° F. now is circulated through the water jacket of tank 15 until the liquid refrigerant in this tank is heated to a temperature of about 175° F. and reaches a pressure of about 300 psi. The check valve 22 prevents any return of the refrigerant liquid from tank 15 up into tank 10 at this time.

Next, valve 24 is opened to pass the heated, pressurized liquid refrigerant from tank 15 to the vane motor inlet 26. At this time, the pressurized refrigerant is still in a liquid state. The pressurized refrigerant drives the vane motor 27 (which is connected to an electric generator or other utilization device, not shown) and it passes through the vane motor outlet 28 to the return line 29, where some of all of the refrigerant expand to a gaseous state. The spent refrigerant goes back into the upper tank 10 through the latter's inlet 13. Any refrigerant that may be in a vapor state will be condensed in the tank 10 by the latter's water-cooled outer jacket.

The inlet valves 34, 34*a* and 34*b* to the respective lower tanks 15, 15*a* and 15*b* and their outlet valves 24, 24*a* and 24*b* are operated in a timed sequence such that while liquid refrigerant is being cooled in one of these lower tanks, the refrigerant is being heated in a second lower tank, and heated pressurized refrigerant is being discharged from the third lower tank into the vane motor 27. With this sequential operation of the inlet valves and the outlet valves, which may be done either manually under timed or other automatic control, the vane motor 27 is driven continuously.

To completely avoid or minimize fluctuations in the power output of the vane motor 27, more lower tanks than the three shown in the drawing may be provided, if desired.

Alternatively, just one or two lower tanks may be used in the system if intermittent or fluctuating operation of the vane motor 27 is acceptable.

It is to be understood that the vane motor 27 may be replaced by another type of hydraulic motor or by a hydraulic turbine, if desired.

Also, the sources of the cooling fluid and the heating fluid for the heat exchangers 10, 15, 15*a* and 15*b* may be different from the cooling tower 32 and the steam turbine or turbines 31 shown schematically in the drawing.

I claim:

1. A closed loop power system for use with a source of hot fluid and a source of cooling fluid, said system comprising:

a first heat exchanger having a container for holding a working fluid in a liquid state at elevated temperature and pressure;

a second heat exchanger having a container for holding the working fluid;

means for passing the working fluid from said container in the first heat exchanger in a liquid state at elevated temperature and pressure to said container in the second heat exchanger;

means for supplying said cooling fluid from said source thereof to said second heat exchanger to cool the working fluid therein;

means operable thereafter to supply hot fluid from said source thereof to said second heat exchanger to heat the working fluid therein in a liquid state to a pressure substantially higher than its pressure in the first heat exchanger;

a fluid motor having an inlet and an outlet;

means for passing the heated working fluid in a liquid state from said second heat exchanger to the inlet of said fluid motor to drive the latter;

means for passing the working fluid from the outlet of said fluid motor to said container in the first heat exchanger;

and means for cooling the working fluid in said first heat exchanger to said elevated temperature and pressure;

said second heat exchanger being positioned below said first heat exchanger to receive the working fluid therefrom by gravity flow.

2. A system according to claim 1, wherein said hot fluid and said cooling fluid are water.

3. A system according to claim 2, wherein said source of hot fluid comprises steam turbine means, and said source of cooling fluid is a cooling tower.

4. A system according to claim 1, wherein said working fluid is a refrigerant, and said hot fluid and said cooling fluid are water.

5. A closed loop power system for use with a source of hot fluid and a source of cooling fluid, said system comprising:

a first heat exchanger having a container for holding a working fluid in a liquid state at elevated temperature and pressure;

a second heat exchanger having a container for holding the working fluid;

means for passing the working fluid from said container in the first heat exchanger in a liquid state at elevated temperature and pressure to said container in the second heat exchanger;

means for supplying said cooling fluid from said source thereof to said second heat exchanger to cool the working fluid therein;

means operable thereafter to supply hot fluid from said source thereof to said second heat exchanger to heat the working fluid therein in a liquid state to a pressure substantially higher than its pressure in the first heat exchanger;

a fluid motor having an inlet and an outlet;

means for passing the heated working fluid in a liquid state from said second heat exchanger to the inlet of said fluid motor to drive the latter;

means for passing the working fluid from the outlet of said fluid motor to said container in the first heat exchanger;

means for cooling the working fluid in said first heat exchanger to said elevated temperature and pressure;

a third heat exchanger having a container for holding the working fluid;

means for passing the working fluid from said container in the first heat exchanger in a liquid state at said elevated pressure and temperature to said container in the third heat exchanger alternately with the passing of the working fluid from said container in the first heat exchanger to said container in the second heat exchanger;

means for supplying said cooling fluid from said source thereof to said third heat exchanger to cool the working fluid therein alternatively with the cooling of the working fluid in said second heat exchanger;

means operable after the working fluid is cooled in said third heat exchanger to supply hot fluid from said source thereof to said third heat exchanger to heat the working fluid therein to a pressure higher than its pressure in said first heat exchanger;

and means for passing the heated working fluid in a liquid state from said third heat exchanger to said inlet of the fluid motor alternatively with the passing of the heated working fluid from said second heat exchanger to said inlet of the fluid motor.

6. A system according to claim 5, and further comprising:

a fourth heat exchanger having a container for holding the working fluid;

means for passing the working fluid from said container in the first heat exchanger in a liquid state at said elevated pressure and temperature to said container in the fourth heat exchanger in sequence with the passing of the working fluid from said first heat exchanger to said second and third heat exchangers successively;

means for supplying said cooling fluid from said source thereof to said fourth heat exchanger to cool the working fluid therein in sequence with the cooling of the working fluid in said second and third heat exchangers successively;

means operable after the working fluid is cooled in said fourth heat exchanger to supply hot fluid from said source thereof to said fourth heat exchanger to heat the working fluid therein to a pressure higher than its pressure in said first heat exchanger;

and means for passing the heated working fluid in a liquid state from said fourth heat exchanger to said inlet of the fluid motor in sequence with the passing of the heated working fluid to said inlet of the fluid motor from said second and third heat exchangers in succession.

* * * * *